US010153108B2

(12) United States Patent
Tanaka et al.

(10) Patent No.: US 10,153,108 B2
(45) Date of Patent: Dec. 11, 2018

(54) PRESSING INPUT DEVICE

(71) Applicant: ALPS ELECTRIC CO., LTD., Tokyo (JP)

(72) Inventors: Takaki Tanaka, Miyagi-ken (JP); Tatsuo Sugawara, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 15/696,380

(22) Filed: Sep. 6, 2017

(65) Prior Publication Data

US 2018/0068814 A1 Mar. 8, 2018

(30) Foreign Application Priority Data

Sep. 6, 2016 (JP) ..... 2016-173992

(51) Int. Cl.

| | |
|---|---|
| ***H01H 21/28*** | (2006.01) |
| ***H01H 13/18*** | (2006.01) |
| ***H01H 21/24*** | (2006.01) |
| ***H01H 21/12*** | (2006.01) |

(52) U.S. Cl.

CPC ..... *H01H 21/24* (2013.01); *H01H 13/186* (2013.01); *H01H 21/12* (2013.01); *H01H 21/285* (2013.01); *H01H 2205/002* (2013.01); *H01H 2235/01* (2013.01)

(58) Field of Classification Search

CPC ..... H01H 21/28; H01H 21/24; H01H 21/14; H01H 21/282; H01H 21/285

See application file for complete search history.

(56) References Cited

U.S. PATENT DOCUMENTS 2,468,673 A * 4/1949 Kaminky ..... H01H 13/14 200/335
2,817,725 A * 12/1957 Rochfort ..... H01H 5/04 200/332
3,484,572 A * 12/1969 Froyd ..... H01H 13/186 200/332
3,648,004 A * 3/1972 Williams, III ..... H01H 13/186 200/288
4,295,017 A * 10/1981 Kashima ..... H01H 13/20 200/330

FOREIGN PATENT DOCUMENTS

| | | | |
|---|---|---|---|
| DE | 102014217184 | A1 | 3/2016 |
| EP | 1 734 548 | A1 | 12/2006 |
| JP | 52-80484 | A | 7/1977 |
| JP | 2006-092996 | A | 4/2016 |

* cited by examiner

*Primary Examiner* — Felix O Figueroa
(74) *Attorney, Agent, or Firm* — Brinks Gilson & Lione

(57) ABSTRACT

A spring piece is formed integrally as part of a drive arm that presses an operational body. The spring piece is disposed between a pressing part at which the drive arm presses the operational body and a linkage part that acts a swinging fulcrum. A contact part between the spring piece and a case is positioned closer to the linkage part than the bend bottom end is. When the drive arm swings from an initial orientation to a completely swung orientation, the spring piece can generate an elastic return force. The elastic return force does not largely increase even when the drive arm swings.

4 Claims, 7 Drawing Sheets

Z1
Z2
X1
X2

PRESSING INPUT DEVICE

CLAIM OF PRIORITY

This application claims benefit of priority to Japanese Patent Application No. 2016-173992 filed on Sep. 6, 2016, which is hereby incorporated by reference in its entirety.

BACKGROUND

1. Field of the Disclosure

The present disclosure relates to a pressing input device that operates an operational body by swinging a drive arm to change the state of an electrically variable part such as a switch.

2. Description of the Related Art

Japanese Unexamined Patent Application Publication No. 2006-92996 describes an arrangement related to a pressing input device (lever driven electrical component). This pressing input device includes, in a case, an operational body that can advance and retreat, a sliding member that is driven by being pushed by the operational body, and a detecting member to which an electric signal is output due to the operation of a sliding member. A drive lever is swingably supported by the case. When an external force is applied to the drive lever and it swings, the operational body is pressed into the interior of the case by the drive lever.

The drive lever of the pressing input device described in Japanese Unexamined Patent Application Publication No. 2006-92996 has a restricting part for preventing an inclination. The driving lever and inclination prevention restricting part abut the contact part of the operational body at an angle. This restricts the inclined operation of the operational body when the operational body is pushed by the drive lever.

The pressing input device described in Japanese Unexamined Patent Application Publication No. 2006-92996 is structured so that when the drive lever is rotated, the operational body is pressed, so an operation force is more easily transmitted to the operational body when compared with a structure in which the operational body is directly pressed. A position at which the operational body is pressed to switch the ON state of a switch mechanism, which is the detecting means provided in the case, to the OFF state or to switch the OFF state to the ON state can be set with respect to the swing angle of the drive lever. This enables a timing to switch the switch mechanism to be easily designed.

However, the structure described in Japanese Unexamined Patent Application Publication No. 2006-92996 lacks a return mechanism that returns the drive lever to its initial orientation as a single component. This is problematic in that the drive lever causes a rattle and rattle noise is likely to occur. Another problem with the structure is that the elastic force of a return spring that protrudes the operational body from the case is used to rotate the drive lever to return it toward its initial orientation, so if a load exerted on the rotational fulcrum of the drive lever is increased, a load used to protrude the operational body from the case becomes excessive, lowering reliability in the operation of the operational body.

A possible solution to the above problems is a structure in which a leaf spring is provided so that the base of the leaf spring is fixed to the case, instead of the drive lever. The leaf spring is warped to press the operational body. In this structure, when the operation force exerted on the leaf string is removed, the leaf spring can return to its initial orientation due to its elastic force.

In this structure, however, the longer a distance by which the leaf string is pressed is, the more the leaf spring is warped and the larger elastic reaction force becomes. This increases the operation load. To reduce the operation load, it is necessary to elongate the leaf string to lower its spring constant. To use the leaf spring in an elastic region for a long time, it is also necessary to elongate the leaf spring to lower internal stress generated when the leaf string is warped. As a result, it becomes difficult to downsize the pressing input device.

SUMMARY

A pressing input device that includes: a fixed part; an operational body supported by the fixed part so as to be capable of advancing and retreating; an electrically variable part, the state of the electrically variable part being changed by the operation of the operational body; and a driving arm that swings around a linkage part linked to the fixed part, the linkage part acting as a fulcrum, in a direction in which the drive arm presses the operational body; the pressing input device according to the present invention is characterized in that a spring piece is attached to the drive arm, the bottom end of the spring piece is positioned between the linkage part and a pressing part at which the drive arm presses the operational body, the spring piece is in contact with the fixing part, and when the drive arm swings in the direction in which the drive arm presses the operational body, the spring piece is deformed so as to warp.

DESCRIPTION OF THE EXEMPLARY EMBODIMENTS

Figure 1:
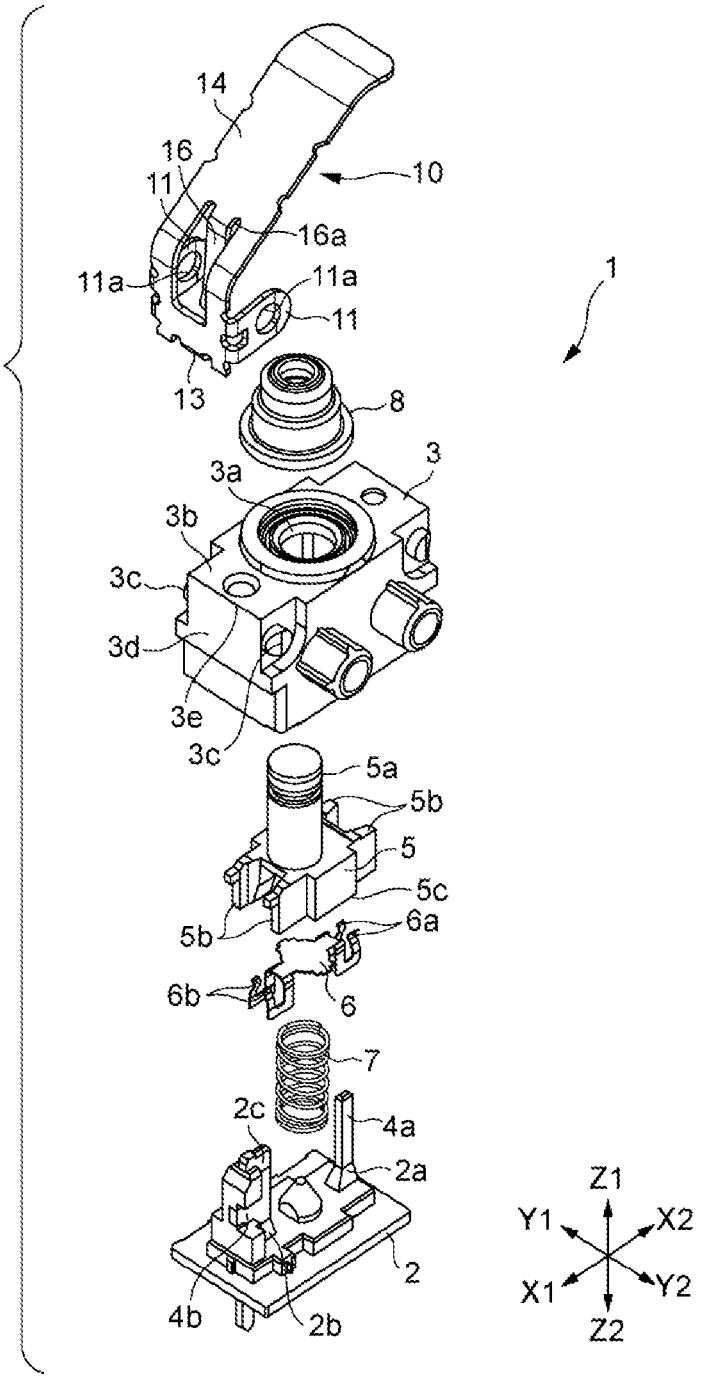
FIG. 1 is an exploded perspective view of a pressing input device in a first embodiment of the present invention.

As illustrated in FIG. 1, a pressing input device 1 in a first embodiment of the present invention has a base 2 and a case 3. As illustrated in FIGS. 2A to 2D, the case 3 is fixed onto the base 2. The base 2 and case 3 form a fixed part.

The base 2 is made of a synthetic resin. A first fixed contact 4*a* and a second fixed contact 4*b* are buried in the base 2. The first fixed contact 4*a* and second fixed contact 4*b* are made of a conductive metal plate. The first fixed contact 4*a* is positioned on the X2 side, and the second fixed contact 4*b* is positioned on the X1 side. The first fixed contact 4*a* is exposed from a resin protrusion 2*a* formed on the base 2 and extends in the Z1 direction. Similarly, the second fixed contact 4*b* is exposed from a resin protrusion 2*b* formed on the base 2 and extends in the Z1 direction. However, an insulative sliding part 2*c* is formed on the top of the second fixed contact 4*b* on the Z1 side so as to be continued to the top; the insulative sliding part 2*c* is integrally formed from the synthetic resin forming the base 2.

An operational body 5 is accommodated in the case 3. The operational body 5 integrally has an operational protrusion 5*a* extending in the Z1 direction and two sliding parts 5*b* extending in the Z1-Z2 direction, one of which is formed on the X1 side and the other of which is formed on the X2 side. An operation hole 3*a* is formed in the upper surface 3*b* of the case 3 in the Z1 direction. The operational protrusion 5*a* of the operational body 5 is inserted into the operation hole 3*a*, and the sliding parts 5*b* are guided in the Z1-Z2 direction by a guiding part formed in the case 3 so that the operational body 5 is supported in the case 3 so as to be movable in the Z1-Z2 direction.

A movable contact 6 is fixed to the bottom part 5*c* of the operational body 5. The movable contact 6 is formed from a conductive metallic leaf spring. The movable contact 6 has a first holding part 6*a* and a second holding part 6*b*. The first holding part 6*a* holds the first fixed contact 4*a*, and the second holding part 6*b* holds the insulative sliding part 2*c* and second fixed contact 4*b*.

A return spring 7, which is a compressing spring, is provided between the base 2 and the movable contact 6. The return spring 7 constantly urges the operational body 5 in the Z1 direction.

In this description, the first fixed contact 4*a*, second fixed contact 4*b*, insulative sliding part 2*c*, and movable contact 6 constitute an electrically variable part. This electrically variable part is a switch mechanism that is switched between an OFF state, in which the first fixed contact 4*a* and second fixed contact 4*b* are insulated from each other, and an ON state, in which the first fixed contact 4*a* and second fixed contact 4*b* are electrically connected, according to the position of the movable contact 6, which moves together with the operational body 5. The electrically variable part may be any device if its electric state and the state of an electronic signal can be switched or can change. An example of the electrically variable part is a multi-contact switch mechanism in which a plurality of contacts can make a switchover between an insulated state and an electrically connected state, according to the movement of the operational body 5. Another example is a variable resistor the resistance of which changes according to the movement of the operational body 5.

A waterproof cap 8 is attached to the top of the case 3 in the Z1 direction. As illustrated in FIGS. 2A to 2D, the waterproof cap 8 covers a clearance between the operation hole 3*a* and the base of the operational protrusion 5*a*, which protrudes from the operation hole 3*a*.

A drive arm 10 is attached to the case 3. The drive arm 10 is formed from an elastically deformable metallic plate. The drive arm 10 integrally has a pair of support pieces 11 at the base with a space left between them in the Y1-Y2 direction. The support pieces 11 are bent toward the X2 direction. A linkage hole 11*a* is made in each support piece 11. A pair of linkage protrusions 3*c* are integrally formed on the X1 side of the case 3, one of which protrudes in the Y1 direction, and the other of which is protrudes in the Y2 direction. Each linkage hole 11*a* is swingably (rotatably) supported by the corresponding linkage protrusion 3*c*. The linkage hole 11*a* and linkage protrusion 3*c* form a linkage part (see FIGS. 2A to 2D), which is a swinging fulcrum of the drive arm 10. The pair of support pieces 11 may be disposed so as to slightly press both side of the case 3 to the extent that the swinging of the drive arm 10 is not impeded.

Alternatively, the pair of support pieces 11 may be disposed so as to leave the minimum space between each support piece 11 and the case 3.

Figures 2A, 2B, 2C, 2D:
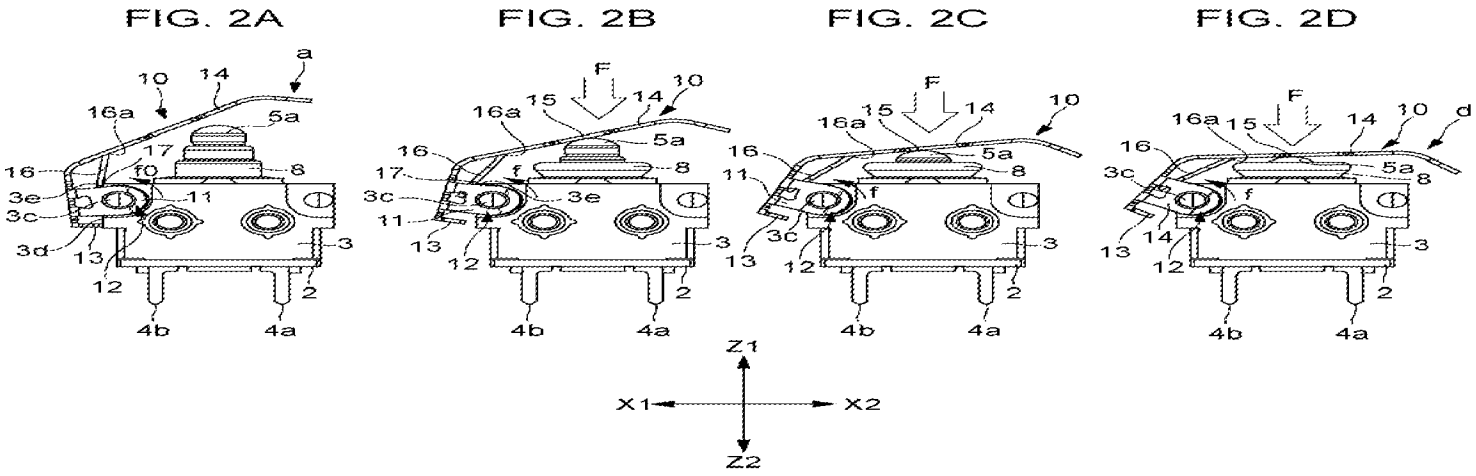
FIGS. 2A to 2D are front views, each of which illustrates a different operation of the pressing input device in FIG. 1.

The drive arm 10 has a stopper piece 13 below the support pieces 11 (on the Z2 side), which is formed so as to be bent. As illustrated in FIG. 2A, when stopper piece 13 abuts the side surface 3*d* of the case 3, the drive arm 10 cannot rotate further counterclockwise.

The drive arm 10 has an operational piece 14, which extends from the support pieces 11 at angle toward the Z1 direction and X2 direction. As illustrated in FIGS. 2B to 2D, a portion at which the lower surface of the operational piece 14 touches the upper end of the operational protrusion 5*a* is a pressing part 15. The position of the pressing part 15 on the drive arm 10 slightly differs in FIGS. 2B to 2D. The position of the pressing part 15 shifts on the drive arm 10 toward the linkage part 12, starting from in the position in FIG. 2B and leading to the positions in FIGS. 2C and 2D in that order.

The operational piece 14 of the drive arm 10 has a spring piece 16 between the pair of support pieces 11 and the pressing part 15. The spring piece 16 is preferably formed integrally as part of the drive arm 10 by cutting part of the metallic plate, from which the drive arm 10 is formed, and raising the cut portion. The spring piece 16 is bent from its bend bottom end 16*a* downwardly at an angle. The spring piece 16 is formed to such a dimension that the spring piece 16 is elastically warped. In an embodiment in which the drive arm 10 and a spring piece are integrally formed, the bend bottom end 16*a* is the bottom end of the spring piece.

As illustrated in FIG. 1, an angular part 3*e* is formed between the upper surface 3*b* and side surface 3*d* of the case 3. As illustrated in FIGS. 2A to 2D, the spring piece 16 slidably is in contact with the angular part 3*e*. This contact portion is a contact part 17.

Next, the operation of the pressing input device 1 will be described.

FIG. 2A illustrates an initial state in which no external force is exerted on the drive arm 10. In this initial state, the spring piece 16 is in contact with the angular part 3*e* of the case 3 at the contact part 17, in a state in which the spring piece 16 is warped. Due to the elastic return force of the spring piece 16, an initial rotational urging force f0 is exerted counterclockwise on the drive arm 10. Therefore, the stopper piece 13 remains in contact with the side surface 3*d* of the case 3, stabilizing the orientation of the drive arm 10. In this state, the operational piece 14 of the drive arm 10 is separated from the operational protrusion 5*a* of the operational body 5. Since the initial rotational urging force f0 is exerted, it is possible to prevent the drive arm 10 from rattling in the initial state illustrated in FIG. 2A.

In the initial state illustrated in FIG. 2A, the operational body 5 has been moved in the Z1 direction due to the elastic force of the return spring 7 illustrated in FIG. 1, so the first holding part 6*a* of the movable contact 6 fixed to the bottom part 5*c* of the operational body 5 holds the first fixed contact 4*a*, and the second holding part 6*b* holds the insulative sliding part 2*c*. Therefore, the operational state of the electrically variable part is the OFF state, in which an electrical connection between the first fixed contact 4*a* and the second fixed contact 4*b* is broken.

In an apparatus in which the pressing input device 1 is installed, when a to-be-detected part, such as a cam or slider, which is moved by a mechanism, moves and abuts the surface of the operational piece 14 of the drive arm 10 on the Z1 side, an operational force F is exerted on the drive arm 10 so as to swing it toward the case 3.

The operational force F causes the drive arm 10 to swing clockwise with the linkage part 12 acting as a swinging fulcrum. In the process in which the drive arm 10 is swung clockwise, the operational piece 14 abuts the operational protrusion 5*a* at the pressing part 15, as illustrated in FIG. 2B. When the drive arm 10 is further swung as illustrated in FIGS. 2C and 2D in succession in that order, the operational piece 14 presses the operational body 5 in the interior of the case 3 in the Z2 direction.

When the operational body 5 is pressed in the interior of the case 3 in the Z2 direction, the second holding part 6*b* moves from the position at which it has been holding the insulative sliding part 2*c* to the position at which the second holding part 6*b* holds the second fixed contact 4*b*, while the first holding part 6*a* of the movable contact 6, which moves together with the operational body 5, holds the first fixed contact 4*a*. Then, the first fixed contact 4*a* and second fixed contact 4*b* are electrically interconnected through the movable contact 6, switching the state of the electrically variable part to ON.

While the drive arm 10 is swinging clockwise with the linkage part 12 acting as a swinging fulcrum, the spring piece 16 in contact with the angular part 3*e* of the case 3 at the contact part 17 is deformed so as to warp with the bend bottom end 16*a* acting as a fulcrum. Due to the elastic return force generated by the warp of the spring piece 16, a rotational return force f in the counterclockwise direction continues to act on the drive arm 10. Therefore, when the operational force F is removed, the drive arm 10 swings counterclockwise due to the rotational return force f and returns to the initial orientation as illustrated in FIG. 2A. As a result of the drive arm 10 returning to the initial orientation, the operational body 5 also moves in the Z1 direction due to the elastic return force of the return spring 7 and returns to the initial position.

With the pressing input device 1 in the first embodiment, the rotational return force f generated by the warp of the spring piece 16 does not become excessive even when the drive arm 10 swings clockwise and the drive arm 10 does not give an excessive operational reaction force even when the drive arm 10 swings as illustrated in FIGS. 2B to 2D in succession in that order. An amount by which the spring piece 16 warps when the drive arm 10 swings clockwise is small, so even if the free length of the spring piece 16 is short, excessive stress is not exerted on the spring piece 16 and the fatigue of the spring piece 16 can be reduced. Even if the spring piece 16 is short, an appropriate rotational return force f can be given to the spring piece 16 and its fatigue can be reduced, so the drive arm 10 can be downsized and the pressing input device 1 can thereby be downsized.

How the spring piece 16 is warped will be described below in details.

Figure 3:
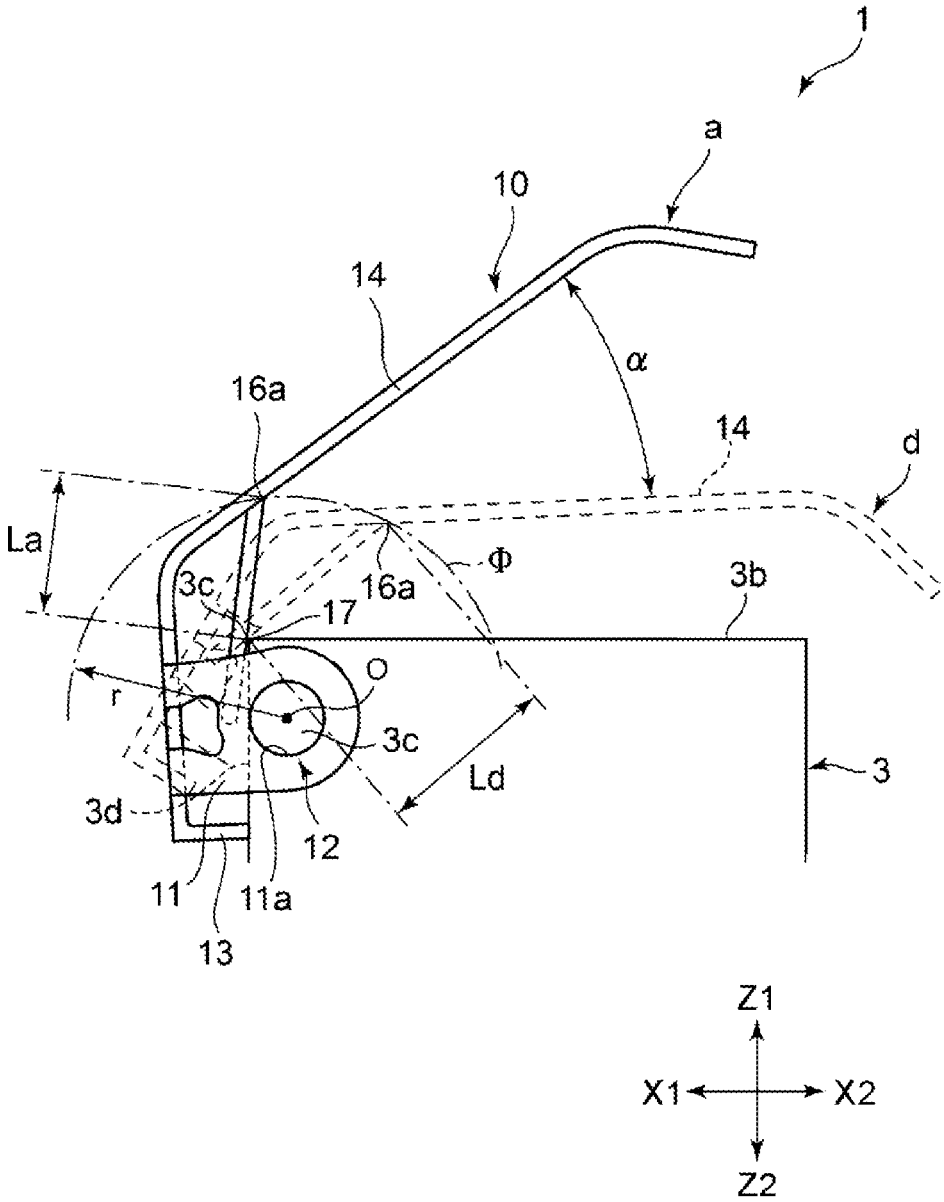
FIG. 3 illustrates the rotational operation of a drive arm and the warp operation of a spring piece.

FIG. 3 illustrates an operation of the drive arm 10 when it swings clockwise. In FIG. 3, the drive arm 10 in the initial orientation "a" illustrated in FIG. 2A is indicated by solid lines, and the drive arm 10 in a completely swung orientation "d" illustrated in FIG. 2D is indicated by broken lines. A swing angle formed between the initial orientation "a" of the drive arm 10 and its completely swung orientation "d" is indicated by α. In an embodiment, the swing angle α is slightly larger than 30 degrees.

As illustrated in FIG. 3, when the drive arm 10 swings clockwise from the initial orientation "a" to the completely swung orientation "d", the bend bottom end 16*a* of the spring piece 16 moves along an arc path Φ that has a fixed radius r and also has a center O at the linkage part 12.

The bend bottom end 16*a* of the spring piece 16 is positioned between the pressing part 15, which presses the operational protrusion 5*a*, and the linkage part 12, which acts as the swinging fulcrum. The contact part 17 between the spring piece 16 and the angular part 3*e* of the case 3 is preferably positioned closer to the linkage part 12 than the bend bottom end 16*a* is. That is, the contact part 17 is preferably positioned closer to the swinging fulcrum of the drive arm 10 than the bend bottom end 16*a* is. Therefore, when the drive arm 10 swings clockwise from the initial orientation "a" to the completely swung orientation "d", the bend bottom end 16*a* rotates in a direction oriented so as to reduce the amount of warp of the spring piece 16.

Figure 5:
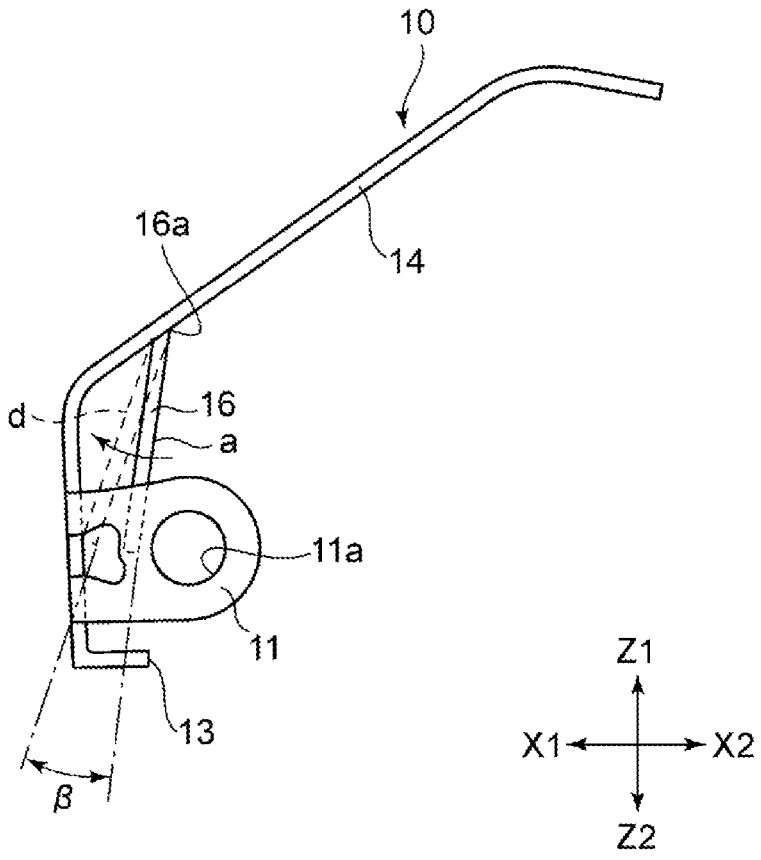
FIG. 5 illustrates the rotational operation of the drive arm and the warp operation of a spring piece.

In FIG. 5, the orientation of the spring piece 16 of the drive arm 10 in the initial orientation "a" is indicated by solid lines, and the orientation of the spring piece 16 of the drive arm 10 in the completely swung orientation "d" is indicated by broken lines. An angle by which the spring piece 16 warps while the drive arm 10 swings from the initial orientation "a" to the completely swung orientation "d" is indicated by β. Preferably, this warp angle β is adequately smaller that the swing angle α, illustrated in FIG. 3, of the drive arm 10. Therefore, the drive arm 10 rotates, starting from the initial orientation "a" in FIG. 2A, as illustrated in FIGS. 2B to 2D in succession in that order, the elastic return force generated due to the warp of the spring piece 16 only slightly increases and the rotational return force f exerted on the drive arm 10 also only slightly increases.

As illustrated in FIG. 3, with the pressing input device 1 in the first embodiment, a relative position between the linkage part 12 acting as the swinging fulcrum and the contact part 17 formed between the spring piece 16 and the case 3 preferably does not change but remains constant while the drive arm 10 swings. The bend bottom end 16*a* of the spring piece 16 moves along the arc path Φ that has the radius r and also has the center O at the linkage part 12. The contact part 17 is preferably positioned between the center O and the drive arm 10.

Therefore, when the drive arm 10 swings clockwise, the spring piece 16 preferably slides on the angular part 3*e* of the case 3 at the contact part 17. As a result, a length Ld from the bend bottom end 16*a* of the spring piece 16 to the contact part 17 in the completely swung orientation "d" illustrated in FIG. 2D is preferably longer than a length La from the bend bottom end 16*a* of the spring piece 16 to the contact part 17 in the initial orientation "a" illustrated in FIG. 2A. That is, as the drive arm 10 swings clockwise, the spring length contributing to the elastic return force of the spring piece 16 is elongated, and thereby as the drive arm 10 swings clockwise, the spring constant is reduced.

While the drive arm 10 swings from the initial orientation "a" to the completely swung orientation "d", the spring piece 16 causes a warp with an angle of β as illustrated in FIG. 5, generating an elastic return force. At the same time, the spring length of the spring piece 16 is increased from La to Ld, lowering the spring constant. Therefore, while the drive arm 10 swings from the initial orientation "a" to the completely swung orientation "d", the rotational return force f is not greatly increased from the initial rotational urging force f0.

Figure 4A:
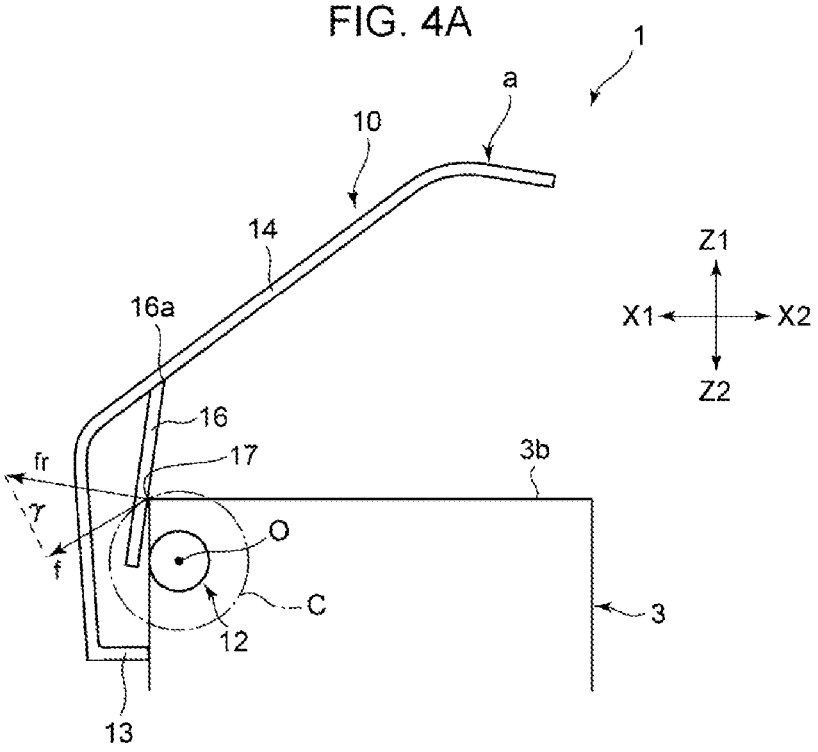
FIGS. 4A and 4B illustrate the rotational operation of the drive arm and a change in an elastic return force.
Figure 4B:
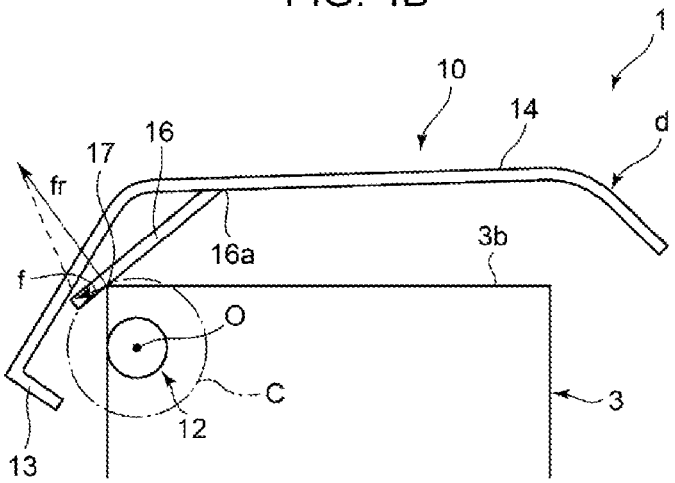

FIG. 4A illustrates a positional relationship between the spring piece 16 and the contact part 17 in the initial orientation "a", and FIG. 4B illustrates a positional relationship between the spring piece 16 and the contact part 17 in the completely swung orientation "d", which is reached when the drive arm 10 has completely swung clockwise. In FIGS. 4A and 4B, a virtual circle C that passes the contact part 17 is illustrated, the center of the virtual circle C being the center O of the linkage part 12, that is, the center around which the drive arm 10 swings.

In FIGS. 4A and 4B, the elastic return force, of the spring piece 16, which is exerted on a contact point between the spring piece 16 and the contact part 17 is indicated as an elastic reaction force fr. The elastic reaction force fr is exerted perpendicularly on the plate surface of the spring piece 16. Between the initial orientation "a" and the completely swung orientation "d", there is a change in the amount of warp of the spring piece 16 and there is also a change in the spring length. Therefore, the elastic reaction force fr is supposed to change. For convenience of explanation, however, both the elastic reaction force in the initial orientation "a" and the elastic reaction force in the completely swung orientation "d" will be denoted here as fr. In each orientation of the drive arm 10, the component force of the elastic reaction force fr in the direction of the tangent of the virtual circle C, the tangent passing the contact part 17, is the rotational return force f that causes the drive arm 10 to rotate counterclockwise.

An angle γ is formed between the orientation of the elastic reaction force fr perpendicularly exerted on the spring piece 16 at the contact part 17 and the tangent of the virtual circle C, the tangent passing the contact part 17. The angle γ is preferably increased as the drive arm 10 swings clockwise as illustrated in FIGS. 2B to 2D in succession in that order, and the ratio of the rotational return force f to the elastic reaction force fr is reduced as the drive arm 10 swings clockwise.

As described above, when the position of the bend bottom end 16*a* and an angle at which the spring piece 16 of the drive arm 10 extends are set, it is possible to set the rotational return force f so that as the drive arm 10 swings clockwise, the rotational return force f is reduced. In addition, when the position of the bend bottom end 16*a* is changed and the angle at which the spring piece 16 of the drive arm 10 extends is changed to an arbitrary angle, it is possible to set the rotational return force f so that an amount by which the rotational return force f changes can be changed in response to a change in the swing angle of the drive arm 10.

Figure 6:
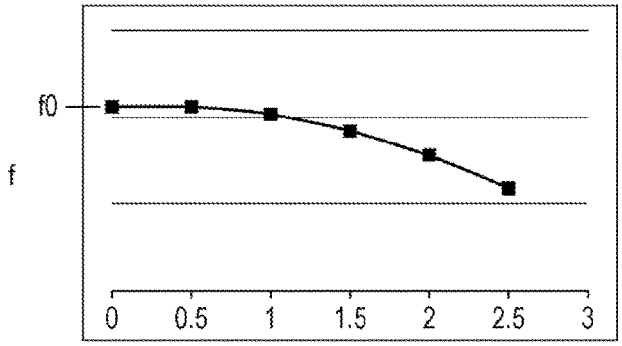
FIG. 6 is a graph representing a relationship between the amount of warp of the drive arm and the elastic return force.

FIG. 6 illustrates changes in the rotational return force f generated by the spring piece 16 when the drive arm 10 is swung from the initial orientation "a" to the completely swung orientation "d" in a state in which the return spring 7 and operational body 5 are removed. That is, FIG. 6 illustrates changes in the rotational return force f under a condition in which there is no influence by the return spring 7. The horizontal axis in FIG. 6 indicates an amount by which the pressing part 15 of the operational piece 14 moves in the Z2 direction, and the vertical axis indicates changes in the rotational return force f. With the pressing input device 1 in the first embodiment, while the drive arm 10 swings from the initial orientation "a" to the completely swung orientation "d", the rotational return force f generated due to the warp of the spring piece 16, if anything, tends to be lowered.

Figure 7:
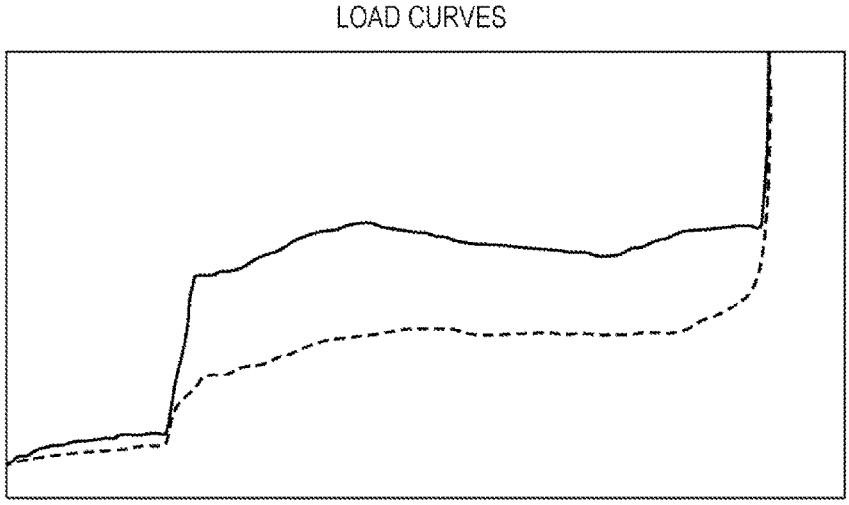
FIG. 7 is a graph representing changes in a load exerted on the drive arm when the pressing input device is operated.

FIG. 7 illustrates a load exerted on a forward path along which the drive arm 10 swings from the initial orientation "a" to the completely swung orientation "d" and a load exerted on a backward path along which the drive arm 10 returns from the completely swung orientation "d" to the initial orientation "a", in a state in which all parts of the pressing input device 1 are incorporated in it. The horizontal axis indicates an amount by which the operational body 5 moves in the Z2 direction, and the vertical axis indicates the magnitude of the load exerted on the drive arm 10. In FIG. 7, the solid-line curve indicates changes in the load on the forward path and the broken-line curve indicates changes in the load on the backward curve.

With the pressing input device 1 in the first embodiment, when the drive arm 10 is swung from the initial orientation "a" to the completely swung orientation "d", the elastic return force given from the return spring 7, which is a compression spring, to the operational body 5 is increased as illustrated in FIG. 7, but the rotational return force f generated by the spring piece 16 is gradually lowered as illustrated in FIG. 6. Therefore, an increase in the elastic force of the return spring 7 is substantially cancelled by the rotational return force f, and the operational reaction force generated when the drive arm 10 swings becomes substantially constant. If anything, the operational reaction force tends to be lowered as the drive arm 10 swings clockwise.

Figure 8:
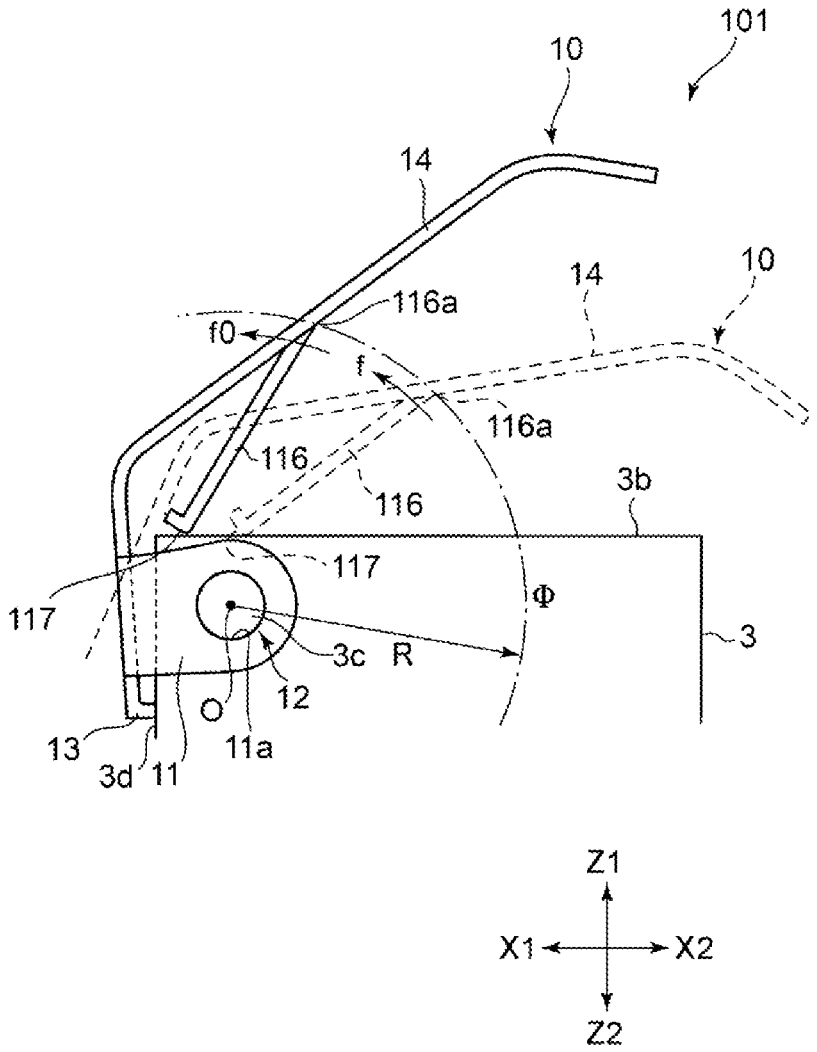
FIG. 8 illustrates a pressing input device in a second embodiment of the present invention.

FIG. 8 illustrates part of a pressing input device 101 in a second embodiment of the present invention.

With this pressing input device 101, a deformed part is formed at the top end of a spring piece 116 that is bent from the operational piece 14 of the drive arm 10 and extends. The deformed part abuts the upper surface 3*b* of the case 3, forming a contact part 117. When the drive arm 10 swings from the initial orientation "a" to the completely swung orientation "d", the top end of the spring piece 116 preferably slides on the upper surface 3*b* of the case 3, shifting the position of the contact part 117 between the spring piece 116 and the upper surface 3*b* in the X1-X2 direction.

With this pressing input device 101 as well, the contact part 117 is preferably positioned closer to the linkage part 12 than the bend bottom end 116*a* of the spring piece 116 is, and the bend bottom end 116*a* moves on an arc path Φ that has a radius R and also has the center O at the linkage part 12. Therefore, when the drive arm 10 swings from the initial orientation "a" toward the completely swung orientation "d", the warp angle of the spring piece 116 of the drive arm 10 is small, so the rotational return force f generated by the spring piece 116 can be reduced to a value lower than the initial rotational urging force f0 in the initial orientation "a".

With the pressing input device 101 in the second embodiment as well, therefore, it is possible to reduce the rotational load of the drive arm 10.

Although the spring piece 16 in the first embodiment and the spring piece 116 in the second embodiment are formed integrally with the operational piece 14 of the drive arm 10, the spring pieces 16 and 116 may be formed separately from the drive arm 10 and may be attached to the operational piece 14. In an embodiment in which a spring piece is formed separately and is attached to a drive arm, a part at which the spring piece is combined with, connected to, or fixed to the drive arm 10 is the base of the spring piece.

What is claimed is:

1. A pressing input device comprising:

a fixed part;

an operational body supported by the fixed part so as to be capable of advancing and retreating;

an electrically variable part, a state of the electrically variable part being changed by an operation of the operational body;

a linkage part linked to the fixed part;

a driving arm that swings around the linkage part in a direction in which the drive arm presses the operational body, the linkage part acting as a fulcrum;

a spring piece attached to the drive arm;

a pressing part at which the drive arm presses the operational body; and a contact part between the spring piece and the fixed part; wherein:

a connecting end of the spring piece is positioned between the pressing part and the linkage part, the contact part is positioned closer to the linkage part than the connecting end of the spring piece, the spring piece is in contact with the fixing part, when the drive arm swings in the direction in which the drive arm presses the operational body, the spring piece is deformed so as to warp, a warp angle of the spring piece is smaller than a swing angle of the drive arm, the swing angle being formed when the drive arm swings in the direction in which the drive arm presses the operational body, a relative position between the linkage part and the contact part does not change when the drive arm swings in the direction in which the drive arm presses the operational body, the contact part is positioned between the linkage part and the drive arm, the spring piece slides on the fixed part at the contact part, and a distance between the connecting end of the spring piece and the contact part gradually increases as the drive arm swings in the direction in which the drive arm presses the operational body.

2. The pressing input device according to claim 1, wherein an angle is increased as the drive arm swings in the direction in which the drive arm presses the operational body, the angle being formed between an orientation of an elastic reaction force perpendicularly exerted on a plate surface of the spring piece at the contact part and a tangent of a virtual circle that passes the contact part, the center of the virtual circle being a center around which the drive arm swings, the tangent passing the contact part.

3. The pressing input device according to claim 1, wherein the spring piece is formed integrally from a metallic plate material, the drive arm being formed from the metallic plate material.

4. A pressing input device comprising:

a fixed part;

an operational body supported by the fixed part so as to be capable of advancing and retreating;

an electrically variable part, a state of the electrically variable part being changed by an operation of the operational body;

a linkage part linked to the fixed part;

a driving arm that swings around the linkage part in a direction in which the drive arm presses the operational body, the linkage part acting as a fulcrum;

a spring piece attached to the drive arm;

a pressing part at which the drive arm presses the operational body; and a contact part between the spring piece and the fixed part, wherein:

the contact part is positioned closer to the linkage part than the connecting end of the spring piece, a connecting end of the spring piece is positioned between the pressing part and the linkage part, the spring piece is in contact with the fixing part, when the drive arm swings in the direction in which the drive arm presses the operational body, the spring piece is deformed so as to warp, and a distance between the connecting end of the spring piece and the contact part gradually increases as the drive arm swings in the direction in which the drive arm presses the operational body.

* * * * *